US005497951A

United States Patent [19]

Watajima

[11] Patent Number: 5,497,951

[45] Date of Patent: Mar. 12, 1996

[54] ROTOR BLADE STRUCTURE FOR VERTICAL SHAFT IMPACT CRUSHER

[75] Inventor: Teruji Watajima, Takeo, Japan

[73] Assignee: Nakayama Iron Works, Ltd., Takeo, Japan

[21] Appl. No.: 172,278

[22] Filed: Dec. 23, 1993

[30] Foreign Application Priority Data

Jan. 22, 1993 [JP] Japan ..... 5-026029

[51] Int. Cl.[6] ..... B02C 13/14; B02C 19/00

[52] U.S. Cl. ..... 241/300; 241/273

[58] Field of Search ..... 241/188.1, 191, 241/275, 300

[56] References Cited

U.S. PATENT DOCUMENTS

| | | | |
|---|---|---|---|
| 3,272,445 | 9/1966 | Weller | 241/197 |
| 3,767,127 | 10/1973 | Wood | 241/275 |
| 4,787,564 | 11/1988 | Tucker | 241/275 |
| 5,323,974 | 6/1994 | Watajima | 241/300 X |

FOREIGN PATENT DOCUMENTS

| | | |
|---|---|---|
| 2078134 | 6/1982 | United Kingdom . |
| 2248410 | 8/1992 | United Kingdom . |

*Primary Examiner*—Douglas D. Watts
*Attorney, Agent, or Firm*—Armstrong, Westerman, Hattori, McLeland & Naughton

[57] ABSTRACT

A rotor blade structure for a vertical shaft impact crusher which enables the lifetime of blades to increase and facilitates maintenance. In the early stage of wear, it takes place by collision between a blade body (2) of each blade (1), particularly teeth (4) provided thereon, and raw stone. Accordingly, in this stage, rods (9) buried in the blade body (2) do not collide with raw stone. As the wear progresses, the rods (9) become exposed. After the rods (9) have been exposed, raw stone also collides with the rods (9), which have a higher hardness than that of the blade body (2). That is, the blade (1) does not subject the rods (9) to wear from the beginning of use of it, but allows the rods (9) to be subjected to wear after the blade body (2) has become worn to a certain extent.

4 Claims, 9 Drawing Sheets

ROTOR BLADE STRUCTURE FOR VERTICAL SHAFT IMPACT CRUSHER

BACKGROUND OF THE INVENTION

1. Field of the Invention

The present invention relates to a rotor blade structure for a vertical shaft impact crusher. More particularly, the present invention relates to a rotor blade structure for a vertical shaft impact crusher for crushing bulk materials, for example, natural rock, into particles of predetermined diameter.

2. Description of the Background Art

Bulk materials, e.g., natural rock, are crushed in accordance with various uses, for example, aggregate for concrete, paving stone, subgrade material, etc. One type of crusher used for such crushing process is known as impact crusher.

Impact crushers operate on the basis of the principle that rock is accelerated at high speed so as to collide with an impact surface, thereby crushing the rock. Such impact crushers may be roughly divided into two types according to the mode of crushing: anvil type and dead stock type.

In the anvil type impact crusher, a rotor having a plurality of blades on the upper side thereof is rotated at high speed, whereby raw stone cast in the crusher is accelerated by the blades and centrifugally discharged so as to collide with anvils which are disposed in a ring shape around the rotor, thereby crushing the raw stone. The anvil type impact crusher is mainly used for the purpose of crushing raw stone having a relatively large diameter by collision to thereby reduce the size of the raw stone.

On the other hand, the dead stock type impact crusher is used to smooth the surfaces of particles of raw stone which has already been crushed into gravel of desired size and to make the particle size uniform. That is, the dead stock type impact crusher is similar to the anvil type impact crusher in that raw stone is accelerated by blades, but different from the latter in that a dead stock is formed from crushed raw stone at the periphery of the rotor, and this dead stock is used as an impact surface for crushing raw stone.

In either of the anvil type and dead stock type impact crushers, as the service time of the crusher elapses, the blades are worn out. For this reason, manganese steel or other wear-resistant material is used for the blades. However, even if such a material is used, wear of the blades cannot be avoided, and the blades must be frequently replaced with new ones. Various propositions have heretofore been made to reduce the frequency of replacement of the blades and to thereby facilitate maintenance.

For example, Japanese Patent Application Public Disclosure (KOKAI) No. 62-193657 (1987) discloses a vertical shaft impact crusher in which a pair of blades, which define a discharge passage, are provided on the upper side of a rotor in symmetry with respect to the radial direction, and the rotor is rotated forwardly and then backwardly, thereby avoiding non-uniform wear of the blades. With this crusher, the range of collision between raw stone and the blades is enlarged by reversing the direction of rotation of the rotor, so that non-uniform wear can be prevented to a certain extent. Therefore, the frequency of replacement of the blades also decreases. However, it does not mean that the lifetime of each individual blade increases, even if the impact crusher is arranged as described above.

A great variety of impact crushers have heretofore been known in which the blades are curved to form a dead stock from crushed rock on the rotor along the side surfaces of the blades so that the blades are protected from wear by the dead stock (for example, see Japanese Utility Model Application Public Disclosure (KOKAI) Nos. 64-56834 (1989) and 01-163539 (1989)). In this case, since no dead stock is formed at the outer peripheral ends of the blades, a carbide tip is provided on the outer peripheral end of each blade with the surface of the carbide tip exposed with a view to avoiding wear of the blade. In this type of impact crusher, in which the blades are protected by the dead stock, the lifetime of the blades increases to a certain extent by virtue of the presence of the carbide tip. However, when a blade has become worn in excess of a predetermined level, the whole blade must be replaced with a new one, which is a waste of the blade material.

Although the carbide tip is not readily worn out, raw stone directly collides with the carbide tip from the beginning of use of the crusher because it is exposed at the outer peripheral end of each blade. Accordingly, the lifetime of the blades does not increase so much as is expected.

SUMMARY OF THE INVENTION

The present invention has been accomplished on the basis of the above-described conventional technical background, and aims at attaining the following objects.

It is an object of the present invention to provide a rotor blade structure for a vertical shaft impact crusher, which enables the lifetime of blades to increase and thus permits a reduction in the frequency of replacement of the blades.

It is another object of the present invention to provide a rotor blade structure for a vertical shaft impact crusher, which allows blades to wear uniformly and thus permits a reduction in the frequency of replacement of the blades.

It is still another object of the present invention to provide a rotor blade structure for a vertical shaft impact crusher, which allows only a worn portion of a blade to be replaced, thereby enabling the blade material to be effectively used.

To attain these objects, the present invention provides a rotor blade structure for a vertical shaft impact crusher, FIG. 5, having a rotor (20) rotated at high speed about a vertical axis, a plurality of supports (23) provided on the upper side of the outer periphery of the rotor (20) at a regular angular spacing, and a blade (1) disposed on each of the supports (23) so as to cover a side surface of the support (23) which extends substantially radially of the rotor (20). The rotor blade structure includes a blade body (2) having a mounting portion that is attached to the support, and a rigid member (9) buried in the blade body to extend substantially parallel to the vertical axis. The rigid member (9) is made of a material having a higher hardness than that of a material used for the blade body.

The rigid member (9) may be made of a super hard alloy.

The rigid member (9) may be buried in each of the inward and outward end portions of the blade body (2) as viewed in the radial direction of the rotor (20), FIG. 5.

In addition, the present invention provides a rotor blade structure for a vertical shaft impact crusher having a rotor (20) rotated at high speed about a vertical axis, a plurality of supports (23) provided on the upper side of the outer periphery of the rotor (20) at a regular angular spacing, and a blade (1) disposed on each of the supports (23) so as to cover a side surface of the support (23) which extends substantially radially of the rotor (20). The rotor blade structure includes a mounting member (52), FIG. 7, attached to each of the supports (23) so as to cover the above-described side surface, and a blade member (53) attached to a side of the mounting member (52) which extends substantially radially of the rotor (20). An accommodating space (58), FIGS. 10 and 11 is provided in the above-described side of the mounting member (52) for accommodating a part of the blade member (53). The rotor blade structure further includes a device (68), FIG. 11, for detachably retaining the blade member (53) accommodated in the accommodating space (58), and a rigid member (65), FIGS. 9 and 11 provided in a portion of the blade member (53) which projects from the accommodating space so that the rigid member (65) extends substantially parallel to the vertical axis. The rigid member (65) is made of a material having a higher hardness than that of a material used for the blade member (53).

The rigid member (65) may be buried in the blade member (53).

The rigid member (65) may be provided in the blade member (53) in a state of being exposed.

The arrangement may be such that the mounting member (53) covers both side surfaces of the support (23) which extend substantially radially of the rotor (20), and the blade member (53) is attached to each of two sides of the mounting member (52) which extend substantially radially of the rotor (20).

In the early stage of wear, collision takes place between the blade body and raw stone. Accordingly, in this stage, the rigid member does not collide with raw stone. As the wear progresses, the rigid member becomes exposed. After the rigid member has been exposed, raw stone also collides with the rigid member, which has a higher hardness than that of the blade body. That is, the blade in the present invention does not subject the rigid member to wear from the beginning of use of the blade, but allows the rigid member to be subjected to wear after the blade body has become worn to a certain extent.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements, and of which.

DETAILED DESCRIPTION OF THE EMBODIMENTS

One embodiment of the present invention will be described below with reference to the accompanying drawings.

Figure 1:
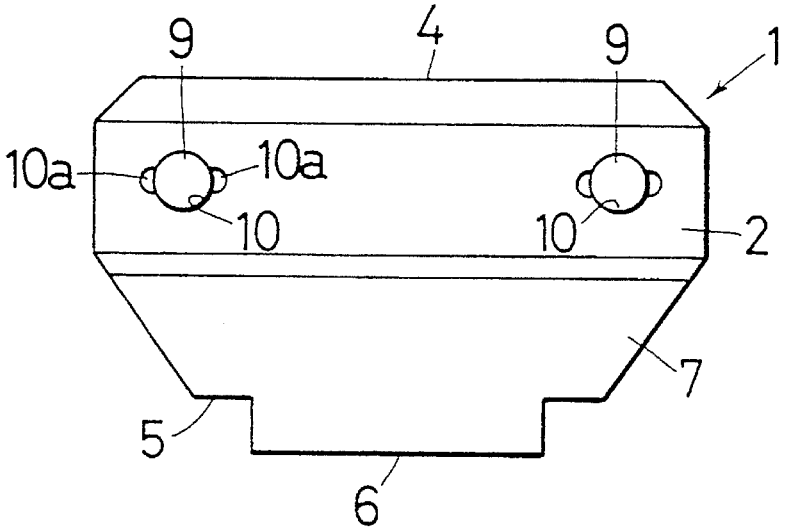
FIG. 1 is a plan view of one embodiment of the present invention.
Figure 2:
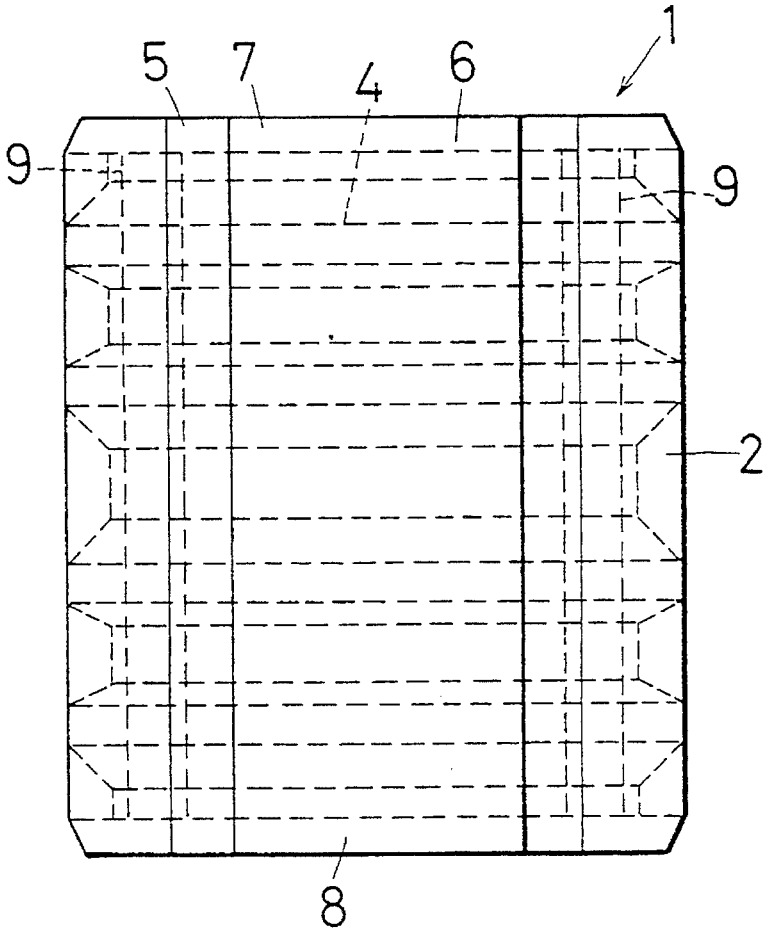
FIG. 2 is a rear view of one embodiment of the present invention.
Figure 3:
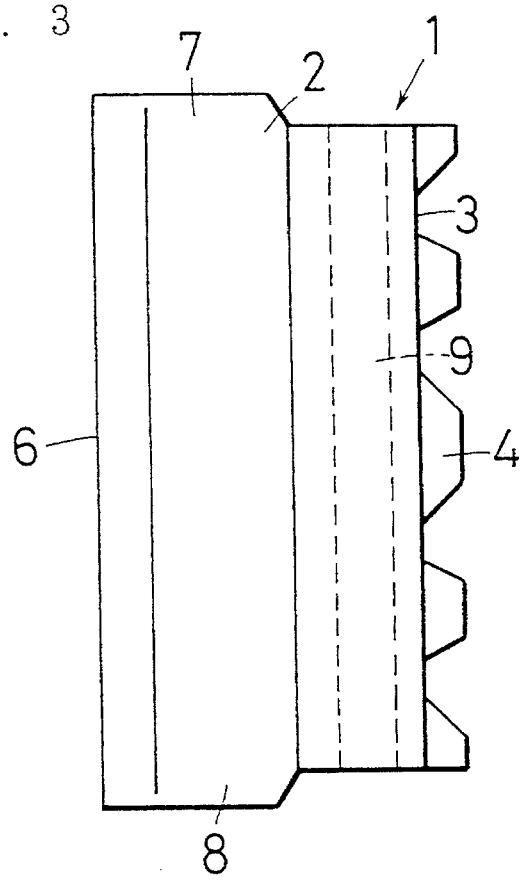
FIG. 3 is a side view of one embodiment of the present invention.
Figure 4:
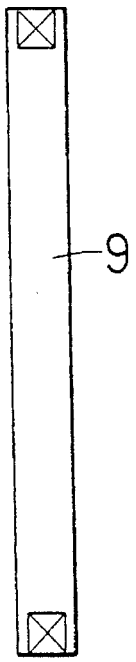
FIG. 4 is a plan view of a rod.

FIG. 1 is a plan view of one embodiment of the rotor blade structure according to the present invention. FIG. 2 is a rear view of the embodiment, and FIG. 3 is a side view of the embodiment.

A blade 1 has a blade body 2 which has a rectangular configuration as a whole. The blade body 2 is made of an ordinary wear-resistant, rigid material, e.g., manganese steel. The front surface of the blade body 2 is defined as an impact surface 3 which comes into collision with raw stone to be crushed. The impact surface 3 is formed with a plurality of teeth 4. The rear surface of the blade body 2 is defined as a mounting surface 5 which is attached to a support of a rotor (described later). The mounting surface 5 is formed with a projection 6 extending over the entire length of the surface 5 in the direction of height thereof for mounting the blade 1 to the support.

Ridges 7 and 8 are formed on the upper and lower sides, respectively, of the blade body 2. A pair of rods 9, which are rigid members, are buried in the blade body 2 at a portion thereof which is intermediate between the impact surface 3 and the mounting surface 5. The rods 9 are made of a material having a higher hardness than that of a material for the blade body 2, which is made of an ordinary wear-resistant material, e.g., manganese steel. In this embodiment, the rods 9 are made of a super hard alloy, e.g., a WC—CO alloy, a WC—TiC—CO alloy, etc.

In this embodiment, the rods 9 are buried into the blade body 2 as follows: The blade body 2 has previously been provided with two bores 10 for burying the rods 9, respectively. The bores 10 each have enlarged-diameter portions **10*a* at respective positions which are diametrically opposite to each other. After the rods 9 have been inserted into the respective bores 10, an epoxy adhesive, for example, and a filler are filled into the enlarged-diameter portions 10*a*, thereby integrating the rods 9 with the blade body 2** into one unit.

Figure 5:
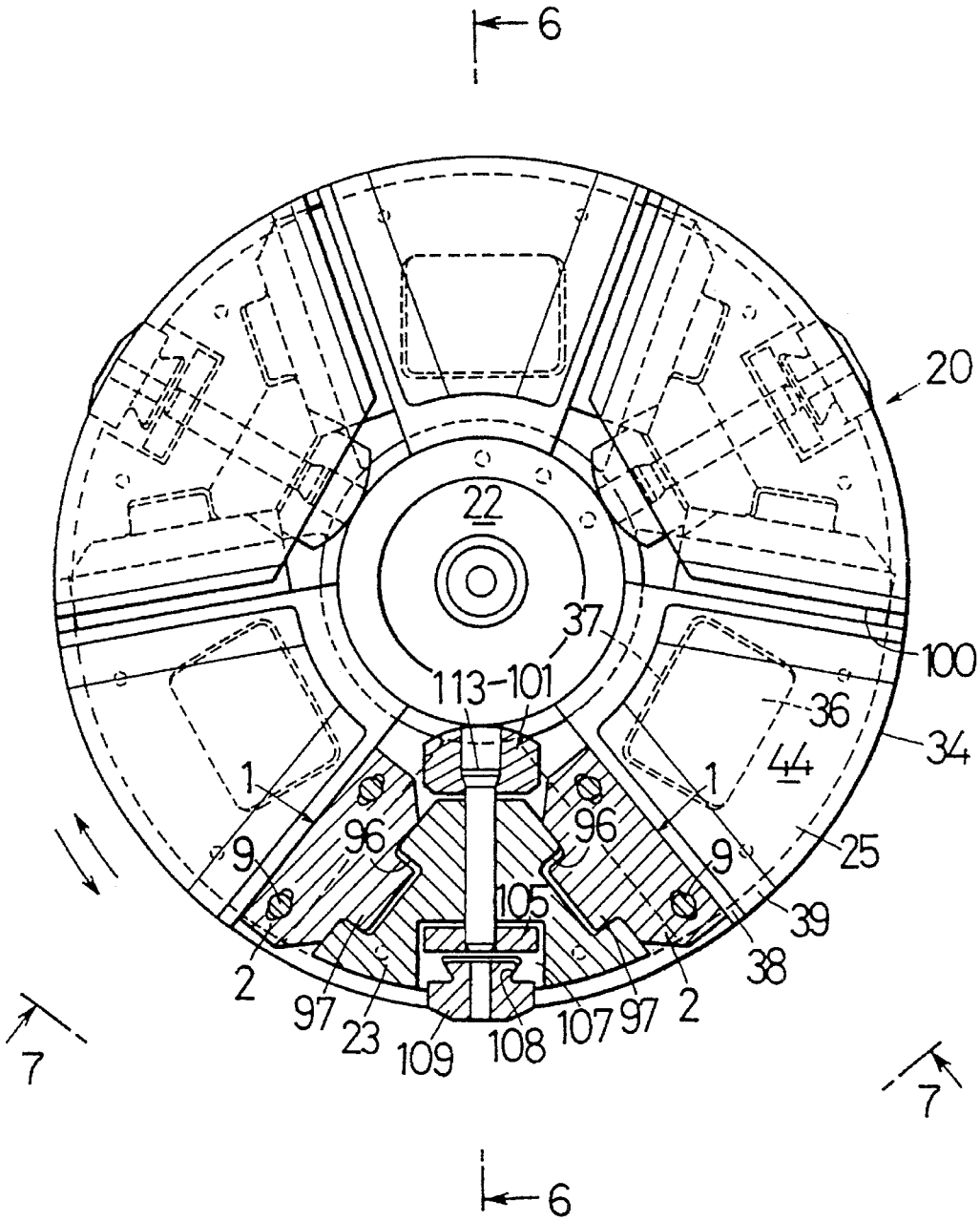
FIG. 5 is a plan view of a rotor to which blades are attached.
Figure 6:
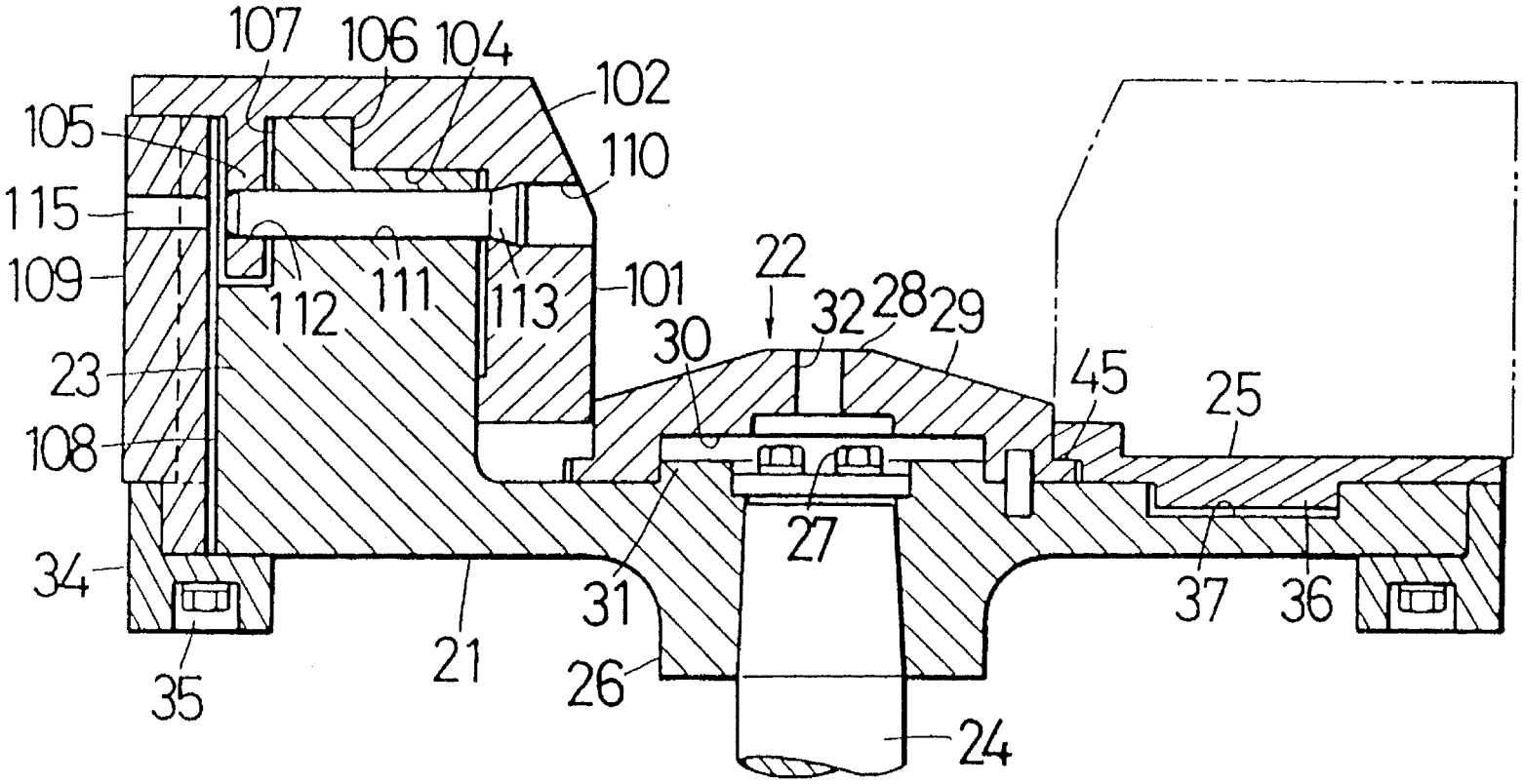
FIG. 6 is a sectional view taken along the line A—A in FIG. 5.
Figure 7:
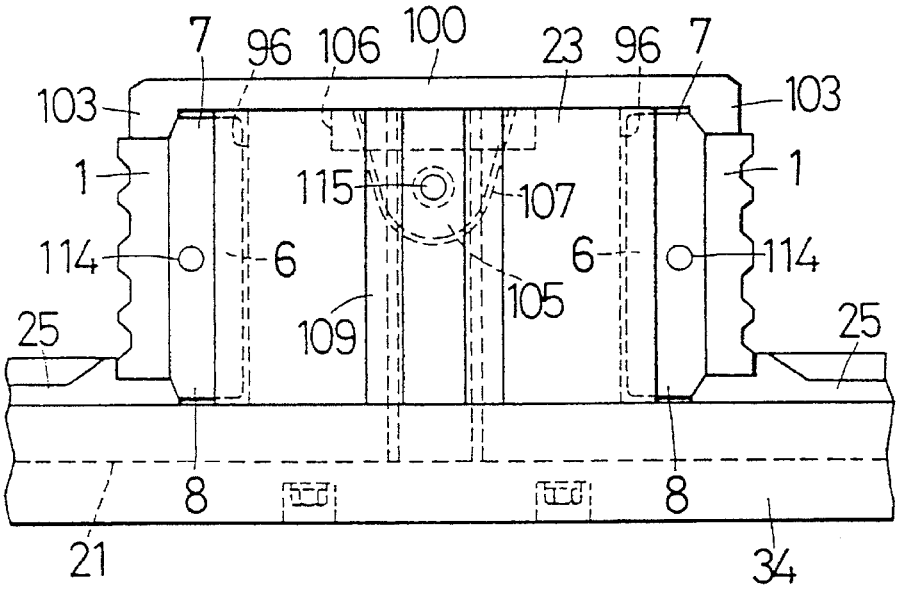
FIG. 7 is a view seen from the arrow B—B in FIG. 5.

The blade 1 is secured to a rotor having the following structure, for example. FIG. 5 is a partly-sectioned plan view of a rotor. FIG. 6 is a sectional view taken along the line A—A in FIG. 5, and FIG. 7 is a view seen from the arrow B—B in FIG. 5. The rotor 20 has a rotor body 21, a distributing plate 22, a plurality of supports 23, blades 1, and discharge passage liners 25.

The rotor body 21 is formed from a disk. The rotor body 21 has a vertical rotating shaft 24 fitted into a boss 26 provided on the lower side thereof, and is fastened to the shaft 24 by bolts 27. The vertical rotating shaft 24 is connected to a reversible motor (not shown) so that the shaft 24 is rotated back and forth in response to the operation of the motor. Around the rotor 20 are disposed anvils (not shown) for collision with raw stone discharged from the rotor 20.

A liner 34 for protection is provided around the outer periphery of the rotor body 21 and secured thereto by bolts 35. The distributing plate 22 is disposed in the center of the upper side of the rotor body 21. The distributing plate 22 has a flat surface 28 formed in the center of the upper side thereof, and a taper surface 29 is formed around the flat surface 28.

In addition, a circular recess 30 is formed on the lower side of the distributing plate 22. The recess 30 is fitted over a circular step portion 31 that is formed on the upper side of the rotor body 21, thereby effecting positioning of the distributing plate 22. The distributing plate 22 has a bore 32 in the center thereof, so that an engagement piece of a suspending member is engaged with the bore 32 during assembly and disassembly.

The supports 23 are disposed on the outer periphery of the distributing plate 22 on the upper side of the rotor body 21. In this embodiment, three supports 23 are provided, and these are disposed at a regular angular spacing of 120 degrees.

Each discharge passage liner 25 is disposed in between a pair of adjacent supports 23. The discharge passage liner 25 has a projection 36 on the lower side, which is fitted into a recess 37 that is provided in the upper side of the rotor body 21, thereby effecting positioning of the discharge passage liner 25. The upper side of the discharge passage liner 25 is formed with two radially extending step portions 38 at both ends thereof in the circumferential direction of the rotor 20. The inner side surfaces 39 of the step portions 38 form taper surfaces. When the discharge passage liner 25 is disposed on the rotor body 21, the inner peripheral end portion of the liner 25 engages with a notch 45 that is provided in the distributing plate 22, thereby pressing down the distributing plate 22.

Each support 23 has vertically extending grooves 96 respectively formed on two side surfaces thereof which extend radially of the rotor body 21. These vertical grooves 96 extend as far as the top of the support 23. The projection 6 formed on the blade 1 is fittable into one of the grooves 96. The grooves 96 may be formed horizontally. However, the vertical grooves 96 enable a pair of blades 1 to be attached to the support 23 by sliding them down into the respective grooves 96 from above the support 23, as described later.

A pair of blades 1 are retained on the support 23 by a top plate 100 that is placed over the support 23. The top plate 100 has a downwardly extending portion 101 at the inward end thereof as viewed in the radial direction of the rotor body 21. The downwardly extending portion 101 has a taper surface 102 on the outer side thereof. The downwardly extending portion 101 is engageable with the inward end face of the support 23 as viewed in the radial direction of the rotor body 21. The top plate 100 further has downwardly extending portions 103 provided on the respective lower sides of both end portions extending radially of the rotor body 21. The downwardly extending portions 103 are engageable with the respective ridges 7 of the blades 1.

The lower side of the central portion of the top plate 100 is provided with a step portion 104 and a downwardly extending plate 105. The step portion 104 is engageable with a step portion 106 that is provided on the upper side of the support 23. The downwardly extending plate 105 is receivable into a recess 107 that is provided in the upper side of the support 23. The outward end portion of the support 23, as viewed in the radial direction of the rotor body 21, is formed with a vertically extending dovetail groove 108, which is contiguous with the recess 107. The dovetail groove 108 is engageable with an end liner 109.

The blades 1 are allowed to slide down onto the support 23 from above so that the projections 6 fit into the respective vertical grooves 96. The blades 1 are provided with bores 114 for engagement with a suspending member (not shown), which is used to mount the blades 1 onto the support 23. In a state where the blades 1 are disposed on both side surfaces of the support 23, the lower ridges 8 of the blades 1 engage with the circumferential end portions of the discharge passage liners 25. Thus, the discharge passage liners 25 are clamped between the blades 1 and the rotor body 21.

After the end liner 109 has been inserted into the dovetail groove 108, the support 23 is covered with the top plate 100. In this state, the step portion 104 of the top plate 100 engages with the step portion 106 of the support 23, and the downwardly extending plate 105 is received into the recess 107. In addition, the downwardly extending portions 103 of the top plate 100 engage with the upper ridges 7 of the blades 1. Thus, the blades 1 are retained on the support 23. As a result, a discharge passage 44, FIG. 5, for raw stone is defined between a pair of opposite blades 1 respectively attached to a pair of adjacent supports 23.

The downwardly extending portion 101 of the top plate 100, the support 23 and the downwardly extending plate 105 of the top plate 100 are provided with respective bores 110, 111 and 112, which match each other. A pin 113 is inserted into the bores 110, 111 and 112, thereby retaining the top plate 100 on the support 23.

Operation

The rotor 20 is first rotated forwardly at high speed by the operation of the driving motor. Raw stone is cast onto the rotor 20 from a feed opening of a housing (not shown). The cast raw stone is distributed to one of the three discharge passages 44 by the distributing plate 22. The raw stone is then accelerated by the blades 1, and discharged toward the anvils surrounding the rotor 20 by centrifugal force. The raw stone is crushed by collision with the anvils and discharged from a discharge opening (not shown). During the crushing process, wear takes place on the distributing plate 22, the discharge passage liners 25 and the blades 1.

Figure 8:
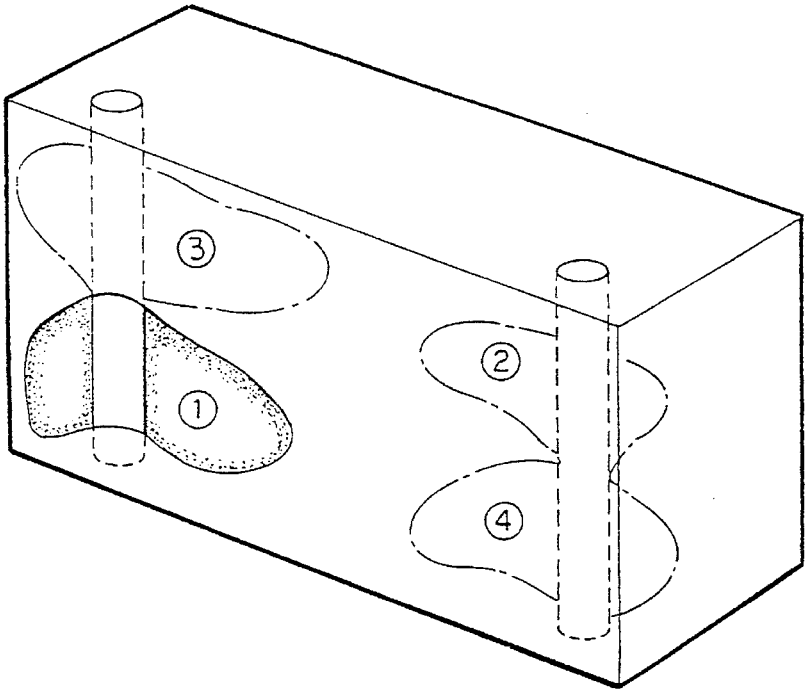
FIG. 8 is a view for explanation of the sequence in which a blade becomes worn.

During the forward rotation of the rotor 20, wear mainly takes place on one blade 1 on each support 23. In particular, among four regions which are defined by dividing the impact surface 3 of the blade 1 both lengthwise and breadthwise into four equal parts, as shown in FIG. 8, the first region ①, which lies in lower portion of the outward part of the blade 1 as viewed in the radial direction of the rotor 20, mainly wears during the forward rotation of the rotor 20. When the region ① has become worn in excess of a predetermined level, the blade 1 is removed and turned upside down and then remounted onto the support 23. Consequently, wear then takes place mainly on the second region ②, which is diagonally opposite to the first region ①.

When the second region ② has become worn, the two blades 1 on each support 23 are replaced with each other. In this state, the rotor 20 is rotated backwardly. Consequently, wear takes place on the third region ③, which is one of the remaining two regions. Then, wear takes place on the fourth region ④, which is diagonally opposite to the third region ③, after the blade 1 has been turned upside down. Thus, the blades 1 can be subjected to wear uniformly over the entire surface thereof by rotating the rotor 20 back and forth, turning the blades 1 upside down on the support 23, and reversing the positions of the blades 1 with respect to the support 23, as described above. The same is the case with the other blade 1, although the way in which the blade 1 wears differs from that of the first blade 1 in terms of the direction of rotation of the rotor 20.

Wear in each region takes place as follows. In the early stage of wear, the blade body 2, particularly the teeth 4, are worn by collision with raw stone. Accordingly, in this stage, the rods 9 do not collide with raw stone. As the wear progresses, the rods 9 become exposed.

When the rods 9 are exposed, raw stone also collides with the rods 9, which are made of a super hard alloy and not readily worn. That is, the blade 1 in the present invention does not subject the rods 9 to wear from the beginning of use of it, but allows the rods 9 to be subjected to wear after the blade body 2 has become worn to a certain extent. Accordingly, the lifetime of the blade 1 becomes longer than in the case where the rods 9 are exposed and subjected to collision with raw stone from the beginning of use of the blade 1 by a period of time taken by the blade body 2 alone to become worn.

Second Embodiment

Figure 9:
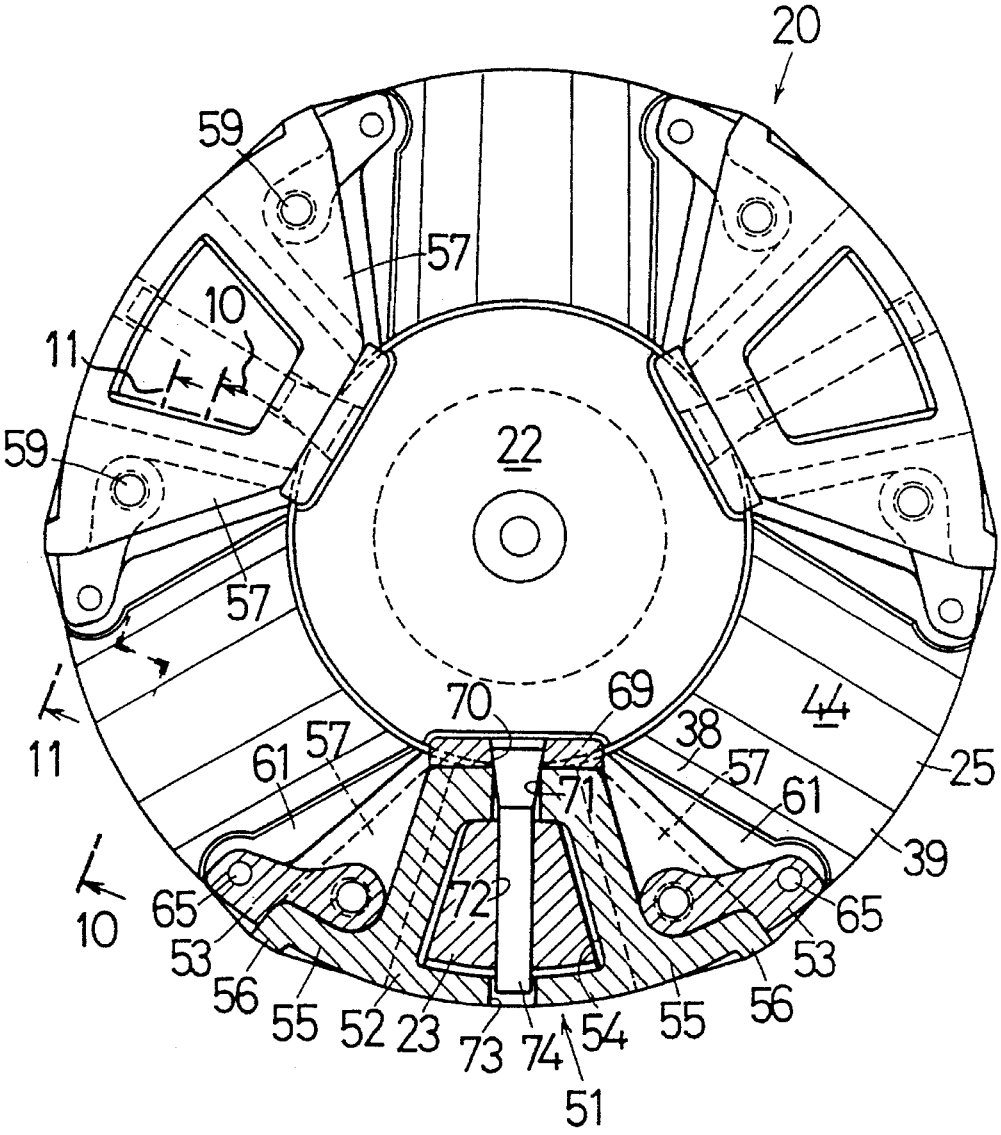
FIG. 9 is a plan view of a rotor to which blades are attached in a second embodiment of the present invention.
Figure 10:
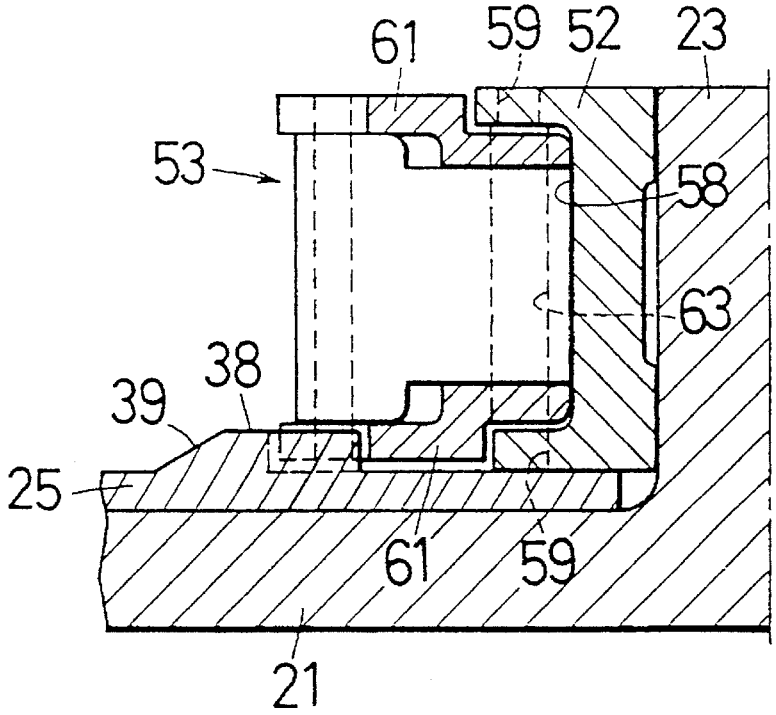
FIG. 10 is a sectional view taken along the line C—C in FIG. 9.
Figure 11:
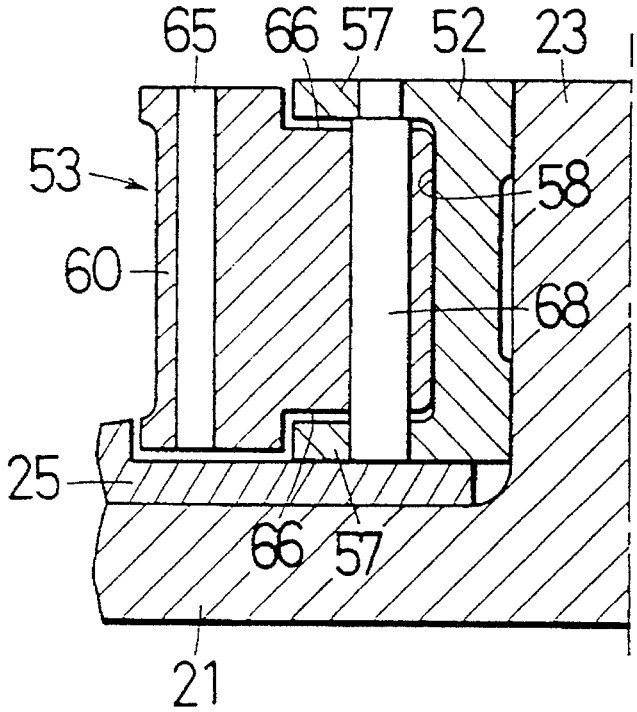
FIG. 11 is a sectional view taken along the line D—D in FIG. 9.

FIG. 9 is a partly-sectioned plan view of a second embodiment of the present invention. FIG. 10 is a sectional view taken along the line C—C in FIG. 9, and FIG. 11 is a sectional view taken along the line D—D in FIG. 9.

A blade 51 in this embodiment is a composite blade which is composed of a mounting member 52 attached to a support 23, and a pair of blade members 53 which are supported by the mounting member 52. The mounting member 52 is formed in the shape of a square cylinder as a whole, which has an approximately square bore 54 in the center thereof. The mounting member 52 is fitted onto the support 23 through the bore 54.

The mounting member 52 has a pair of circumferentially extending portions 55 respectively provided at both circumferential ends of the outward part thereof as viewed in the radial direction of the rotor 20. The respective ends of the circumferentially extending portions 55 are provided with projections 56 which project outwardly of the rotor 20. The two side surfaces of the mounting member 52 that extend radially of the rotor 20 are each formed with a pair of upper and lower mounting plates 57 which extend circumferentially in parallel to each other and which are contiguous with the respective circumferentially extending portions 55. Each pair of mounting plates 57 define a space 58 therebetween for accommodating a blade member 53. The mounting plates 57 are each provided with a pin insertion bore 59.

Figure 12:
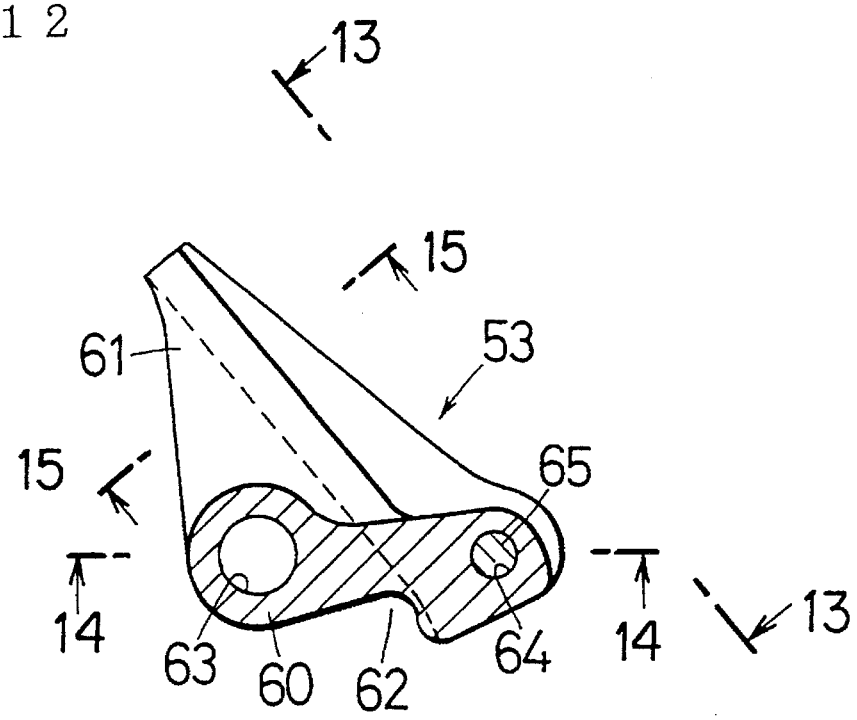
FIG. 12 is a sectional view taken along the line H—H in FIG. 13, showing a part of a blade in the second embodiment of the present invention.

FIG. 12 is a sectional view of a blade member 53. The blade member 53 has a base 60 and a pair of plates 61 which extend horizontally in parallel to each other from the upper and lower ends, respectively, of the base 60. The base 60 has a narrow portion 62 in the center thereof. A pin insertion bore 63 and a rod burying bore 64 are respectively provided on both sides of the narrow portion 62. A rod 65, which is made of a super hard alloy in the same way as in the first embodiment, is inserted into the rod burying bore 64 and secured therein with an adhesive or the like.

The rod 65 need not always be buried, but may be exposed. In such a case, the peripheral surface of the rod 65 may be exposed either partly or wholly except for the upper and lower end portions thereof which are secured to the base 60.

Figure 13:
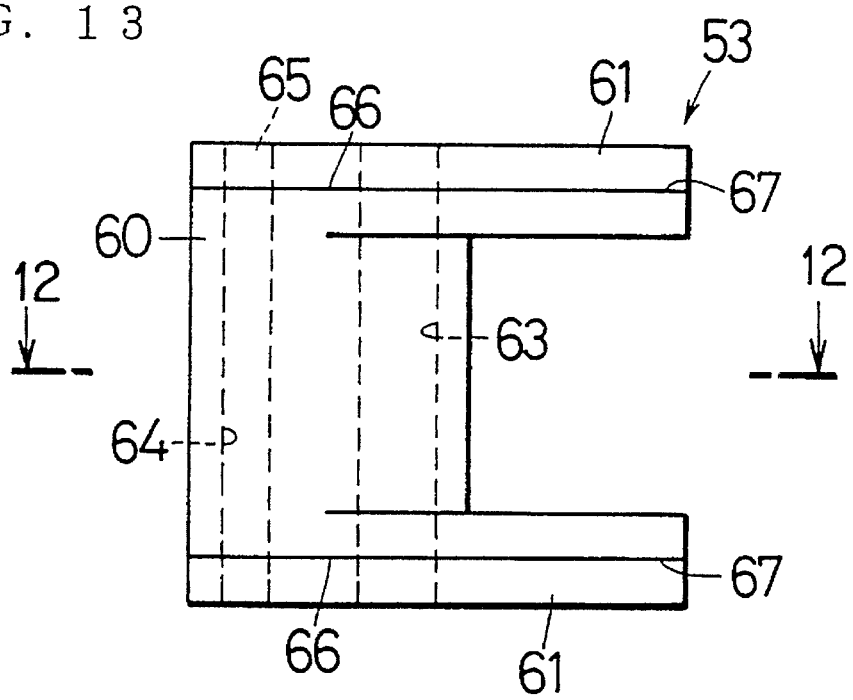
FIG. 13 is a view seen from the arrow E—E in FIG. 12.
Figure 14:
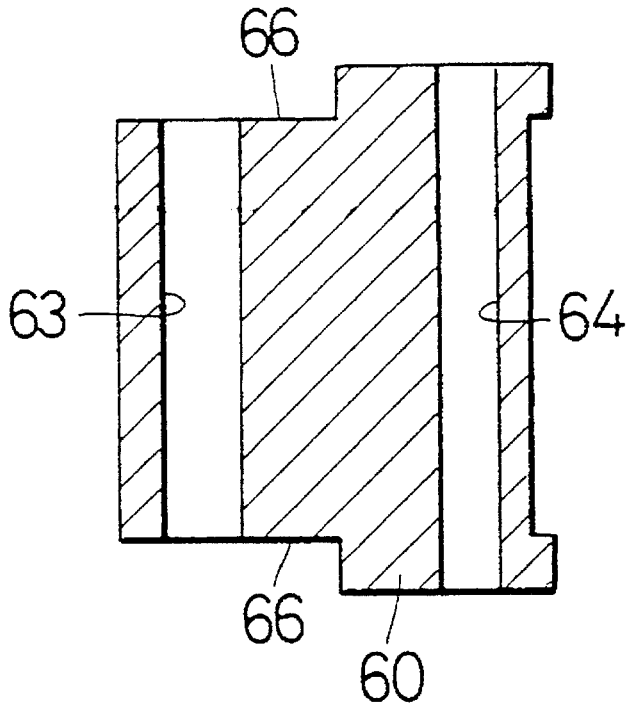
FIG. 14 is a sectional view taken along the line F—F in FIG. 12.
Figure 15:
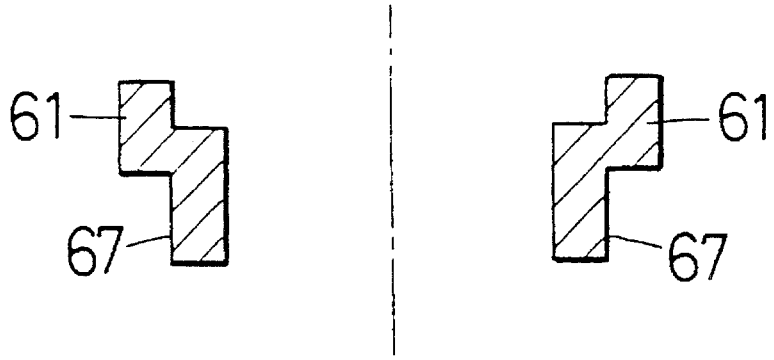
FIG. 15 is a sectional view taken along the line G—G in FIG. 12.

The base 60 has step portions 66 respectively formed on the upper and lower sides of an end portion thereof which is closer to the pin insertion bore 63 than the narrow portion 62 (see FIGS. 13 and 14). The plates 61 are each formed with a step portion 67 corresponding to the step portion 66 (see FIG. 15).

The composite blade 51, FIG. 9 is attached to the support 23 in a state where the blade members 53 have previously been attached to the mounting member 52. That is, the blade members 53 have their step portions 66, FIG. 11, accommodated in the respective accommodating spaces 58 formed in the mounting member 52, and a pin 68 is inserted into the bores 59 and 63, FIG. 10, for each blade member 53, thereby allowing the blade members 53 to be retained on the mounting member 52. In this state, the composite blade 51 is fitted onto the support 23. The device for retaining the blade members 53 is not necessarily limited to the pin 68 but may be a bolt, an eccentric clamp, etc.

In addition, a liner 69, FIG. 9, is disposed at the inward end of the mounting member 52 as viewed in the radial direction of the rotor 20, and a pin 75 is inserted into bores 70, 71, 72 and 73, which are provided in the liner 69, the mounting member 52 and the support 23 so as to align with each other, thereby allowing the composite blade 51 to be retained on the support 23. In consequence of the mounting of the blades 51 onto the respective supports 23, each circumferential end portion of a discharge passage liner 25 is clamped between the rotor body 21 and the mounting member 52.

Operation

The rotor 20 is rotated back and forth by the drive of a reversible motor in the same way as in the first embodiment. During the forward rotation of the rotor 20, wear mainly takes place on the lower half of one blade member 53 of the blade 51. Therefore, when the first blade member 53 has become worn in excess of a predetermined level, the direction of rotation of the rotor 1 is reversed, thereby subjecting the other blade member 53 to wear.

When the second blade member 53 has become worn in excess of a predetermined level, the pin 74 is pulled out, and the blade 51 is removed from the support 23 and turned upside down and then remounted onto the support 23. In this state, the rotor 20 is rotated forwardly and then backwardly, thereby subjecting the remaining half portions of the first and second blade members 53 to wear in the mentioned order. Thus, each blade member 53 can be subjected to wear uniformly over substantially the entire surface thereof. Since the blade 51 can be removed simply by pulling out the pin 74, the operation of removing and remounting the blade 51 is extremely easy. The blade members 53 themselves can also readily be replaced with new ones simply by pulling out the pins 68.

The way in which wear progresses is similar to that in the first embodiment with regard to the vicinities of the rod 65. That is, after the portion of the blade member 53 that surrounds the rod 65 has become worn, the rod 65 is exposed and worn. A portion of the blade member 53 which is away from the rod 65 wears in a manner different from that in the first embodiment. That is, in this embodiment, the edges of the plates 61 form an impact surface for collision with raw stone.

Accordingly, the plates 61 are readily worn and arcuately hollowed out toward the support 23. Particles of crushed rock collect in the resulting hollow portion to form a dead stock. After such a dead stock has been formed, raw stone collides with the dead stock and is accelerated and then discharged from the discharge passage 44.

Other Embodiments

Although in the described embodiments a super hard alloy is employed as a material for the rods, which are rigid members, it should be noted that other material, e.g., a ceramic material, may also be employed as long as it has a sufficiently high hardness. Although in the foregoing embodiments the rods are secured by bonding, it should be noted that the rods may be buried by previously placing them in a mold when the blade 1 or the blade member 53 is produced by casting. Further, although in the foregoing embodiments rods in the shape of a circular cylinder are employed as rigid members, it is also possible to use rigid members in the shape of a prism, a plate, etc.

In addition, although in the first and second embodiments a pair of blades are provided on both side surfaces, respectively, of each support, the arrangement may be such that a blade is provided on only one side surface of each support.

Thus, it is possible according to the present invention to increase the lifetime of the blades and hence reduce the frequency of replacement of them.

In addition, the present invention makes it possible to replace only a worn portion of a blade and hence effectively use the blade material.

Although the present invention has been described through specific terms, it should be noted here that the described embodiments are not necessarily exclusive and that various changes and modifications may be imparted thereto without departing from the scope of the invention which is limited solely by the appended claims.

What is claimed is:

1. A rotor blade structure for a vertical shaft impact crusher having a rotor (20) rotated at high speed about a vertical axis, a plurality of supports (23) provided on the upper side of an outer periphery of said rotor (20) at a regular angular spacing, and a blade (1) disposed on each of said supports (23) so as to cover a side surface of said support (23) which extends substantially radially of said rotor (20), said rotor blade structure comprising:

a mounting member (52) attached to each of said supports (23) so as to cover said side surface;

a blade member (53) attached to a side of said mounting member (52) which extends substantially radially of said rotor (20);

an accommodating space (58) provided in said side of said mounting member (52) for accommodating a part of said blade member (53);

means (68) for detachably retaining said blade member (53) accommodated in said accommodating space (58); and a rigid member (65) provided in a portion of said blade member (53) which projects from said accommodating space so that said rigid member (65) extends substantially parallel to said vertical axis, said rigid member (65) being made of a material having a higher hardness than that of a material used for said blade member (53).

2. A rotor blade structure for a vertical shaft impact crusher according to claim 1, wherein said rigid member (65) is buried in said blade member (53).

3. A rotor blade structure for a vertical shaft impact crusher according to claim 1, wherein said rigid member (65) is provided in said blade member (53) in a state of being exposed.

4. A rotor blade structure for a vertical shaft impact crusher according to claim 1, wherein said mounting member (53) covers both side surfaces of said support (23) which extend substantially radially of said rotor (20), and said blade member (53) is attached to each of two sides of said mounting member (52) which extend substantially radially of said rotor (20).

* * * * *